US012595669B2

(12) United States Patent
Xie et al.

(10) Patent No.: US 12,595,669 B2
(45) **Date of Patent: *Apr. 7, 2026**

(54) ARM SUPPORT AND WORKING DEVICE

(71) Applicant: SANY AUTOMOBILE MANUFACTURING CO., LTD., Changsha (CN)

(72) Inventors: Shihui Xie, Changsha (CN); Xi Guo, Changsha (CN); Jiangbo Li, Changsha (CN)

(73) Assignee: SANY AUTOMOBILE MANUFACTURING CO., LTD., Changsha (CN)

( * ) Notice: Subject to any disclaimer, the term of this patent is extended or adjusted under 35 U.S.C. 154(b) by 843 days.

This patent is subject to a terminal disclaimer.

(21) Appl. No.: 17/909,926

(22) PCT Filed: Aug. 28, 2020

(86) PCT No.: PCT/CN2020/112054

§ 371 (c)(1),
(2) Date: Sep. 7, 2022

(87) PCT Pub. No.: WO2021/179547

PCT Pub. Date: Sep. 16, 2021

(65) Prior Publication Data

US 2024/0200345 A1 Jun. 20, 2024

(30) Foreign Application Priority Data

Mar. 10, 2020 (CN) ..... 202010161710.8

(51) Int. Cl.
*E04G 21/04* (2006.01)

(52) U.S. Cl.
CPC ..... *E04G 21/0445* (2013.01); *Y10T 137/8807* (2015.04)

(58) Field of Classification Search
CPC ..... B66C 23/66; B66C 23/70; E04G 21/0418; E04G 21/0427; E04G 21/0436;
(Continued)

(56) References Cited

U.S. PATENT DOCUMENTS 790,478 A * 5/1905 Byron ..... B66C 23/66 212/347
817,862 A * 4/1906 Mitchell ..... B66C 23/70 212/177

(Continued)

FOREIGN PATENT DOCUMENTS

CN 202248920 U 5/2012
CN 102535857 A 7/2012

(Continued)

OTHER PUBLICATIONS

Da Xu, et al. "Special purpose vehicle structure and design." Beijing Institute of Technology Press. 1998. ISBN 7-81045-492-7. p. 308.

(Continued)

*Primary Examiner* — Kenneth Rinehart
*Assistant Examiner* — Jonthan J Waddy
(74) *Attorney, Agent, or Firm* — IPro, PLLC

(57) ABSTRACT

A working device and an arm support (100) thereof. The arm support (100) comprises a top plate (110), a bottom plate (120), and first and second side plates (130, 140). The top plate (110) and the bottom plate (120) are oppositely disposed at an interval. The first and second side plates (130, 140) are oppositely disposed at an interval. One side and an opposite side of the first side plate (130) are provided with a first and a second bending portion (134, 136), respectively. At least a part of the first and second bending portions (134, 136) are attached and spliced to the top plate (110) and the bottom plate (120), respectively. One side and an opposite side of the second side plate (140) are provided with a third (Continued)

and a fourth bending portion (144, 146), respectively. At least a part of the third and fourth bending portions (144, 146) are attached and spliced to the top plate (110) and the bottom plate (120), respectively. The working device is provided with a chassis, a pump tube and the arm support (100), and adjacent arm supports (100) are hinged to one another. The arm support (100) is suitable for mass production and has low costs.

13 Claims, 6 Drawing Sheets

(58) Field of Classification Search
CPC ..... E04G 21/0445; E04G 21/0454; E04G 21/0463; Y10T 137/8807
USPC ..... 137/615
See application file for complete search history.

(56) References Cited

U.S. PATENT DOCUMENTS 4,418,713 A * 12/1983 Schlecht ..... E04G 21/0436 280/766.1
6,719,009 B1 * 4/2004 Bissen ..... E04G 21/0436 138/140
6,755,212 B1 * 6/2004 Anderson ..... F16L 57/06 428/36.1
6,786,233 B1 * 9/2004 Anderson ..... F16L 3/015 141/387
7,111,745 B2 * 9/2006 Nurse ..... B66C 23/701 52/843
2002/0117219 A1 * 8/2002 Anderson ..... F16L 3/015 137/615
2003/0126772 A1 * 7/2003 Masumoto ..... E02F 3/38 212/347
2004/0161326 A1 * 8/2004 Yamaguchi ..... E02F 3/38 414/722
2006/0257604 A1 11/2006 Anderson et al.
2010/0230371 A1 * 9/2010 Pirri ..... E04G 21/0436 212/347
2011/0132862 A1 * 6/2011 Wimmer ..... E02F 9/2275 212/347
2011/0220228 A1 * 9/2011 Maini ..... E04G 21/0436 29/428
2013/0020274 A1 * 1/2013 Munuswamy ..... B66C 23/80 212/347
2015/0102003 A1 * 4/2015 Maini ..... B66C 23/702 212/347
2015/0107692 A1 * 4/2015 Hasel ..... F16L 3/127 29/525.01
2017/0218645 A1 * 8/2017 Hahn ..... E04G 21/0445
2017/0260761 A1 * 9/2017 Fügel ..... B66C 23/54
2019/0316368 A1 * 10/2019 Akkoc ..... B66C 23/64
2020/0298298 A1 * 9/2020 Mors ..... E04G 21/0445
2020/0370314 A1 * 11/2020 Müller ..... E04G 21/0445
2023/0279679 A1 * 9/2023 Xie ..... E04G 21/0445 248/49
2024/0200346 A1 * 6/2024 Xie ..... E04G 21/0445

FOREIGN PATENT DOCUMENTS

CN 102900235 A 1/2013
CN 103015728 A 4/2013
CN 203113791 U 8/2013
CN 103410326 A 11/2013
CN 203654762 U 6/2014
CN 203729593 U 7/2014
CN 203947781 U 11/2014
CN 106499187 A 3/2017
CN 206418775 U 8/2017
CN 206917279 U 1/2018
CN 207554069 U 6/2018
CN 211946013 U 11/2020
DE 102013225228 A1 6/2015
EP 3224430 A1 10/2017
JP S5950987 U 4/1984
WO 2016059061 A1 4/2016
WO 2018011271 A1 1/2018

OTHER PUBLICATIONS

CN 202010161710.8 first office action dated Nov. 25, 2023.
CN 202010161710.8 second office action dated May 23, 2024.
CN 202010161710.8 rejection decision dated Aug. 14, 2024.
EP 20924785.7 extended European search report dated Mar. 7, 2024.

* cited by examiner

ARM SUPPORT AND WORKING DEVICE

This application claims priority to Chinese Patent Application No. 202010161710.8 filed with China National Intellectual Property Administration on Mar. 10, 2020 and entitled "ARM SUPPORT AND WORKING DEVICE", the entire contents of which are herein incorporated by reference.

FIELD

The present disclosure relates to the technical field of working devices, in particular, to an arm support and a working device.

BACKGROUND

Currently, for working devices such as pump trucks and fire trucks, their arm supports are mainly steel structures, but the arm supports of high-strength steel structures are too heavy. However, most of lightweight arm supports are formed integrally by molds, and this renders that adopted molds are relatively complex, and then renders high costs and too much investment in early process verification. In addition, for an arm support integrally formed by molds, if the structure of the arm support is optimized, the mold needs to be re-adjusted, which is not conducive to mass production.

SUMMARY

The present disclosure aims to solve at least one of the technical problems in the prior art or related art.

Thus, a first aspect of the present disclosure provides an arm support.

A second aspect of the present disclosure provides a working device.

In view of this, the first aspect of the present disclosure provides an arm support comprising a frame structure, wherein the arm support comprises: a top plate; a bottom plate, wherein the bottom plate and the top plate are oppositely disposed at an interval; a first side plate; a second side plate, wherein the second side plate and the first side plate are oppositely disposed at an interval; wherein a first side of the first side plate is provided with a first bending portion, at least a portion of the first bending portion and the top plate are attached and spliced to each other, a second side of the first side plate opposite to the first bending portion is provided with a second bending portion, at least a portion of the second bending portion and the bottom plate are attached and spliced to each other; and a first side of the second side plate is provided with a third bending portion, at least a portion of the third bending portion and the top plate are attached and spliced to each other, a second side of the second side plate opposite to the third bending portion is provided with a fourth bending portion, at least a portion of the fourth bending portion and the bottom plate are attached and spliced to each other, and define the frame structure.

All the top plate, the bottom plate, the first side plate and the second side plate are of a plate structure with a uniform thickness, and the top plate and the bottom plate with an equal thickness can fully exert the compressive and tensile properties of the bottom plate and the top plate. Wherein, corresponding mounting holes are machined in the first side plate and the second side plate according to the structural features of the arm support for installing an axle sleeve, an oil cylinder and etc., and the shape of the bottom plate is matched with a side of the first side plate and a side of the second side plate which are away from the top plate. Since the top plate is a flat plate, the first bending portion and the third bending portion respectively form an included angle with the body of the first side plate and the body of the second side plate, and the included angle is 90°, and therefore, both the first bending portion and the third bending portion can be attached to the top plate. In order to be attached to the bottom plate to achieve the firmness of a connection structure, the second bending portion and the fourth bending portion can match the shape of the plate surface of the bottom plate. Therefore, the top plate, the bottom plate, the first side plate and the second side plate are spliced to each other, and then the arm support is assembled. The splicing structure is firm and simple and is suitable for the combined use of different materials, and this can be easily achieved. Therefore, compared with the arm support with an integral structure, the cost of the mold for making the arm support is reduced, and at the same time, the production efficiency of the arm support is improved.

According to the present disclosure, the above arm support can further comprise the following additional technical features.

The first bending portion and the second bending portion are respectively integrally formed with the first side plate; and the third bending portion and the fourth bending portion are respectively integrally formed with the second side plate.

The two ends of the first side plate are respectively bent to form the first bending portion and the second bending portion, thereby improving the molding efficiency of the first side plate. Similarly, the two ends of the second side plate are respectively bent to form the third bending portion and the fourth bending portion, thereby improving the molding efficiency of the second side plate. Therefore, the production efficiency of the arm support is further improved.

In a possible design, the arm support further comprises a first rib plate, provided on the first side plate and disposed between the first bending portion and the second bending portion; and a second rib plate, provided on the second side plate and disposed between the third bending portion and the fourth bending portion.

The first rib plate and the first side plate are integrally formed, the second rib plate and the second side plate are further integrally formed, and this can not only increase the structure strength of the first side plate and the second side plate, but further simplify the structure and simplify the processing technology.

In a possible design, the arm support further comprises: a middle body; a first connecting portion, provided at one end of the middle body in a length direction; a second connecting portion, provided at the other end of the middle body in a length direction; wherein, the first connecting portion, the second connecting portion and the middle body are enclosed and defined by the top plate, the bottom plate, the first side plate and the second side plate.

The arm support is relatively long, wherein the first connecting portion, the second connecting portion and the middle body are enclosed and defined by the top plate, the bottom plate, the first side plate and the second side plate to form a frame structure. An oil cylinder mounting seat is provided in one end of the first side plate and one end of the second side plate of the middle body away from the top plate. The oil cylinder mounting seat comprises two oil cylinder mounting holes provided in the first side plate and the second side plate, and the two oil cylinder mounting holes are disposed opposite to each other.

The third plate body extends an car plate structure at the connection of the first connecting portion and the end portion of the top plate in a direction away from the second connecting portion and in a direction away from the top plate, and therefore, the side of the third plate body located at the first connecting portion away from the top plate is arc-shaped, and the bottom plate located at the first connecting portion is further arc-shaped, and then, the second bending portion located at the first connecting portion is further arc-shaped. Similarly, since the second connecting portion further has an car plate structure, the side of the third plate body located at the second connecting portion away from the top plate is arc-shaped, and the bottom plate located at the second connecting portion is further arc-shaped, and then, the second bending portion located at the second connecting portion is further arc-shaped. The bottom plate located between the first connecting portion and the second connecting portion can be a plate structure, and thus, the second bending portion located between the first connecting portion and the second connecting portion is further a plate structure, so that the second bending portion is attached to the bottom plate; through the first bending portion and the second bending portion, the first side plate is spliced to the top plate and the bottom plate, and this simplifies the splicing structure and can be achieved easily, and can improve the splicing efficiency of the arm support.

The fourth plate body extends an car plate structure at the connection of the first connecting portion and the end portion of the top plate in a direction away from the second connecting portion and in a direction away from the top plate, and therefore, the side of the fourth plate body located at the first connecting portion away from the top plate is arc-shaped, and the bottom plate located at the first connecting portion is further arc-shaped, and then, the fourth bending portion located at the first connecting portion is further arc-shaped. Similarly, since the second connecting portion further has an car plate structure, the side of the fourth plate body located at the second connecting portion away from the top plate is arc-shaped, and the bottom plate located at the second connecting portion is further arc-shaped, and then, the fourth bending portion located at the second connecting portion is further arc-shaped. The bottom plate located between the first connecting portion and the second connecting portion can be a plate structure, and thus, the fourth bending portion located between the first connecting portion and the second connecting portion is further a plate structure, so that the fourth bending portion is attached to the bottom plate; through the third bending portion and the fourth bending portion, the second side plate is spliced to the top plate and the bottom plate, and this simplifies the splicing structure and can be easily achieved, and can improve the splicing efficiency of the arm support.

In a possible design, the top plate and the bottom plate are respectively carbon fiber plates, and the first side plate and the second side plate are respectively aluminum alloy plates.

The aluminum alloy is lighter compared with a steel plate, and therefore, for the arm support assembled by joining a carbon fiber plate and an aluminum alloy plate, its weight is reduced and its compressive performance is further ensured, and compared with the arm support made from a pure carbon fiber material, the cost of raw materials is reduced. By using the combination of the aluminum alloy and the carbon fiber plate, the cost of the mold for the manufactured arm support is further greatly reduced, and at the same time, compared with the integrally formed carbon fiber arm support, the molding efficiency of the arm support is further improved.

In a possible design, a first steel guard plate is provided on the top of the first connecting portion, and the two opposite sides of the first steel guard plate are respectively connected with the first side plate and the second side plate; a second steel guard plate is provided at the bottom of the first connecting portion, and the second steel guard plate is attached to and fixed with the bottom plate; a third steel guard plate is provided on the top of the second connecting portion, and the two opposite sides of the third steel guard plate are respectively connected with the first side plate and the second side plate; and a fourth steel guard plate is provided at the bottom of the second connecting portion, and the fourth steel guard plate is attached to and fixed with the bottom plate.

Since the first connecting portion and the second connecting portion need to bear the extruding force and gravity generated by rotating connection in the case of hinged connection, in order to increase the structure strength of the first connecting portion, the first steel guard plate is provided on the top of the inclined portion of the first connecting portion, the second steel guard plate is provided at the bottom of the inclined portion of the first connecting portion, and the second steel guard plate and the bottom plate have the same radian, so that the second steel guard plate and the bottom plate are attached to each other at the portion of the first connecting portion. Similarly, in order to increase the structure strength of the second connecting portion, the third steel guard plate is provided on the top of the inclined portion of the second connecting portion, the fourth steel guard plate is provided at the bottom of the inclined portion of the second connecting portion, and the fourth steel guard plate and the bottom plate have the same radian, so that the fourth steel guard plate and the bottom plate are attached to each other at the portion of the second connecting portion.

In a possible design, the first side plate and/or the second side plate further comprises: a first plate body; a second plate body, disposed with the first plate body side by side; wherein a thickness of the first plate body is greater than a thickness of the second plate body, the first side plate and the second side plate are respectively provided with a first plate body at two ends in the length direction, and the second plate body is respectively connected with the two first plate bodies on two opposite sides by friction welding, to splice out the first side plate or the second side plate.

Since the first plate body is located at the end portions of the two ends of the first side plate or the second side plate, that is, the first plate body is located at the first connecting portion and the second connecting portion, the thickness of the first plate body is greater than that of the second plate body, so as to increase structure strength and play a better connecting function. The inner surface of the first plate body and the inner surface of the second plate body are in the same plane, that is, the outer surface of the first plate body protrudes from the outer surface of the second plate body, which can facilitate the installation of the axle sleeve and the like on the first connecting portion and the second connecting portion, and makes the connection between a plurality of arm supports more convenient. Friction welding is a method of using the heat generated by the mutual movement and the mutual friction of the end faces of a workpiece to achieve a thermoplastic state of end portions, and then quickly conducting upsetting and completing welding. Friction stir welding is a kind of friction welding. The friction stir welding further uses friction heat and plastic deformation heat as welding heat sources. Being different from an ordinary friction welding, the welding process of the friction stir welding is that a stirring needle of a cylinder shape or another shape (for example, a threaded cylinder) is extended into the joint of a workpiece, and the high-speed rotation of a welding head makes it rub against a welding workpiece material, and then the temperature of the material at the connection portion raises, and then the material is softened. The first plate body and the second plate body are connected to each other through the friction stir welding, which can ensures the integral structure strength of the first side plate or the second side plate.

In a possible design, the arm support further comprises: an axle sleeve, connected with the first side plate and/or the second side plate through friction welding; wherein the first side plate and the second side plate are provided with at least two axle sleeves opposite to each other.

The axle sleeve in the first side plate and the axle sleeve in the second side plate are symmetrically arranged, and the axle sleeve and the first side plate or the second side plate are further connected by friction welding, wherein the friction welding can further be friction stir welding. The friction stir welding is a mature welding process and is not repeated herein.

In a possible design, the top plate and the bottom plate are respectively bonded with and mechanically connected with the first side plate and the second side plate.

The first side plate is bonded with and mechanically connected with the top plate and the bottom plate, and the second side plate is bonded with and mechanically connected with the top plate and the bottom plate, wherein the mechanical connection is a fastener connecting or riveting, and the fastener connecting can be screw connection, bolt connection, and etc. For example, the top plate and the bottom plate are respectively bonded with the first bending portion and the second bending portion, and then they are connected through fasteners. Similarly, the top plate and the bottom plate are respectively bonded with the third bending portion and the fourth bending portion, and then they are connected through fasteners.

The second aspect of the present disclosure provides a working device which comprises: a chassis; an arm support system, provided on the chassis, wherein the arm support system is provided with a pump tube for conveying materials; wherein the arm support system comprises a plurality of arm supports according to any one of the above embodiments, two adjacent arm supports are hinged to each other, and an arm support at the end portion is connected with the chassis.

The working device provided in the present disclosure comprises the arm support in any one of the designs in the first aspect, and thus it has all the beneficial effects of the arm support of any one of the designs in the first aspect, and is not repeated herein.

The additional aspects and advantages of the present disclosure will be obvious in the following description, or can be understood through the implementation of the present disclosure.

Figure 1:
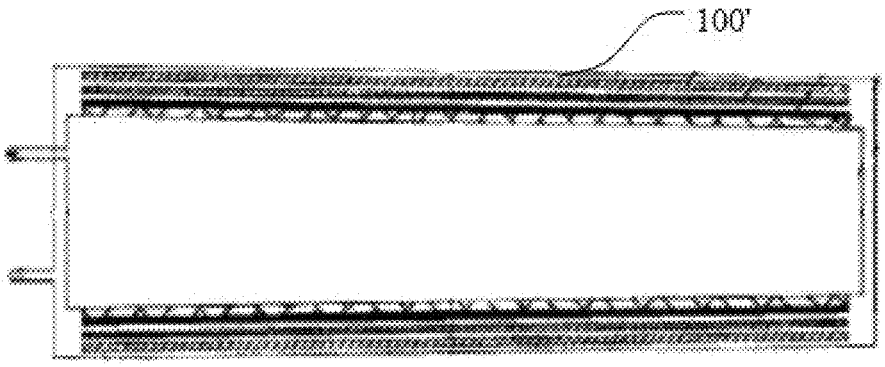
FIG. 1 (Prior Art)
FIG. 1 is a schematic view of the structure of an arm support in a related prior art.

Wherein, the corresponding relations among the reference signs in FIG. 1 and FIG. 2 and the names of the components are as follows:

100': integral carbon fiber arm support; 100": carbon fiber arm support.

The corresponding relations among the reference signs in FIG. 3 to FIG. 8 and the names of the components are as follows:

100: arm support; 102: middle body; 104: first connecting portion; 106: second connecting portion; 110: top plate; 120: bottom plate; 130: first side plate; 132: third plate body; 134: first bending portion; 136: second bending portion; 138: first rib plate; 140: second side plate; 142: fourth plate body; 144: third bending portion; 146: fourth bending portion; 148: second rib plate; 150: axle sleeve; 160: first plate body; 170: second plate body; 180: oil cylinder mounting seat; 190: first steel guard plate; 192: second steel guard plate; 194: third steel guard plate; 196: fourth steel guard plate.

DETAILED DESCRIPTION OF THE DISCLOSURE

In order to understand the above-mentioned objects, features and advantages of the present disclosure more clearly, the present disclosure will be described in further detail with reference to the accompanying drawings and detailed description. It should be noted that the embodiments and features in the embodiments of the present disclosure may be combined with one another without conflicts.

In the following description, numerous specific details are set forth in order to provide a thorough understanding of the present disclosure, but the present disclosure may be practiced otherwise than as described herein, and therefore, the protection scope of the present disclosure is not limited to the exemplary embodiments disclosed below.

In a related prior art, most of the arm supports of concrete pump trucks are mainly steel structures, but the development space of the structure of high-strength steel is very small. Research on lightweight arm supports is mainly focused on carbon fiber composite materials and aluminum alloys, but the current research on both of them is mainly focused on the integral molding of a single material, such as an arm support of a pure carbon fiber composite material, an arm support of a carbon fiber foam sandwich composite material, and the integral carbon fiber arm support 100' as shown in FIG. 1. The production method of the arm support of a carbon fiber composite material comprises inflating a retractable air bag to form an air bag with a first state, laying a carbon fiber prepreg on the outer surface of the air bag, obtaining a component and putting it into a box-shaped mold, and inflating the air bag, and then compressing and shaping the carbon fiber prepreg to obtain a second transition component. The second transition component is subjected to temperature rise and then solidified, and then cooled and demolded after solidification to obtain a carbon fiber arm support. The cost of the integral carbon fiber arm support 100' is relatively high, and this leads to relatively high manufacturing costs of the arm support and a lowered performance-price ratio; and the mold used for the integrally formed arm support model is complex and expensive, and the investment in early process verification is too large. Each structural optimization requires re-adjusting the mold, and this is further extremely unfavorable for the costs of later mass production.

Figure 2:
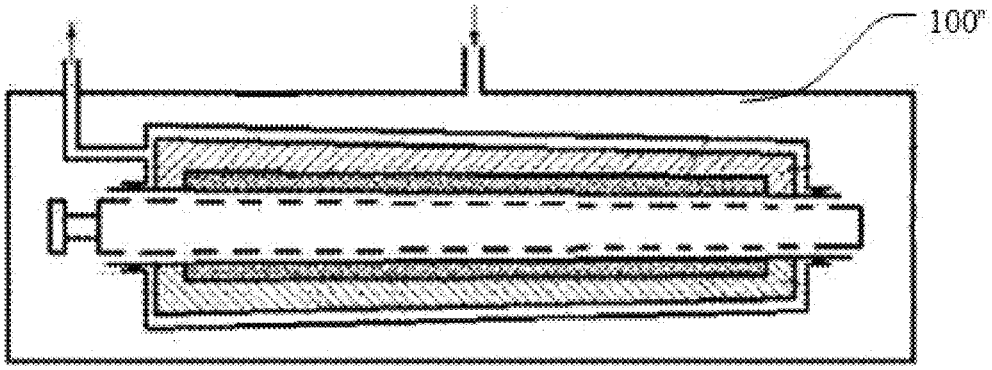
FIG. 2 (Prior Art)
FIG. 2 is a schematic view of the structure of an arm support in another related prior art.

In another related prior art, as shown in FIG. 2, a carbon fiber arm support 100" for a concrete pump truck is provided with an outer mold, the outer mold is composed of an upper mold and a lower mold and has a hollow structure, and the carbon fiber prepreg for manufacturing the carbon fiber arm support 100" is laid on the inner surfaces of the upper mold and the lower mold. The mechanical properties and dimensions of this composite material arm support have extremely high requirements for mold tooling and processes, and this will lead to process instability, and then leads to problems such as internal defects, and there is a connection strength problem in steel structure components, aluminum structure components and carbon fiber composite material structure components.

Referring to FIG. 3 to FIG. 8, the technical solutions of some embodiments of the present disclosure are described in the following.

Embodiment 1

Figure 3:
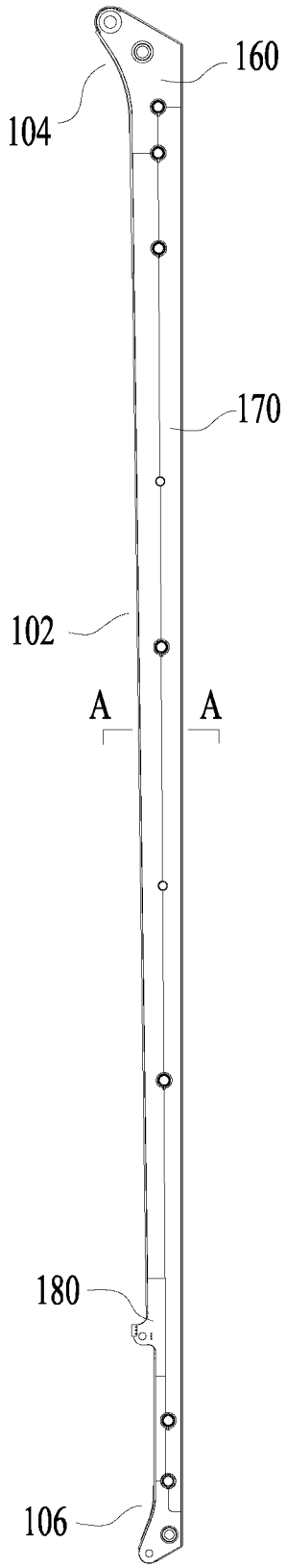
FIG. 3 is a front view of the structure of an arm support according to the embodiments of the present disclosure.
Figure 4:
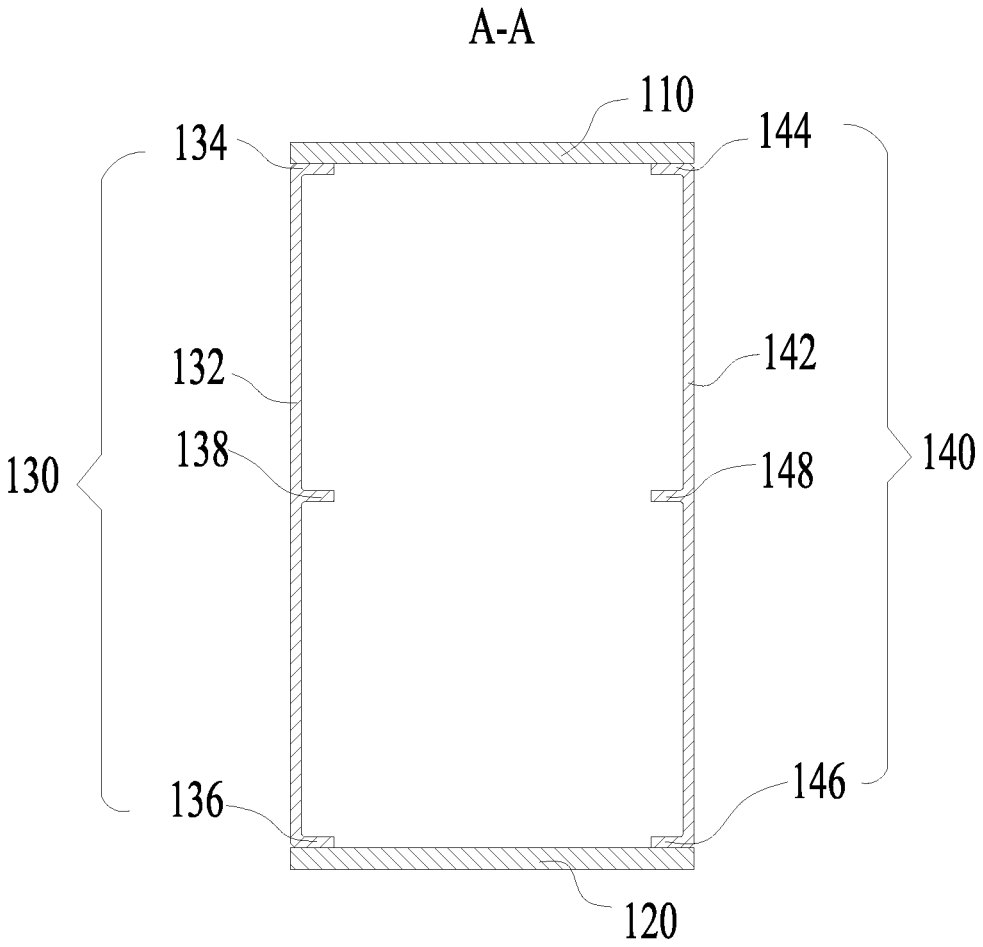
FIG. 4 is a sectional view of the structure in direction A-A in FIG. 3.

As shown in FIG. 3 and FIG. 4, the present embodiment provides an arm support 100 with a frame structure, wherein the arm support 100 comprises: a top plate 110, a bottom plate 120, a first side plate 130 and a second side plate 140, wherein the bottom plate 120 and the top plate 110 are oppositely disposed at an interval, and the second side plate 140 and the first side plate 130 are oppositely disposed at an interval; wherein a first side of the first side plate 130 is provided with a first bending portion 134, at least a portion of the first bending portion 134 is attached and spliced to the top plate 110, a second side of the first side plate 130 opposite to the first bending portion 134 is provided with a second bending portion 136, at least a portion of the second bending portion 136 is attached and spliced to the bottom plate 120; and a first side of the second side plate 140 is provided with a third bending portion 144, at least a portion of the third bending portion 144 is attached and spliced to the top plate 110, a second side of the second side plate 140 opposite to the third bending portion 144 is provided with a fourth bending portion 146, at least a portion of the fourth bending portion 146 is attached and spliced to the bottom plate 120, and define the frame structure.

In the embodiment, all the top plate 110, the bottom plate 120, the first side plate 130 and the second side plate 140 are of a plate structure with a uniform thickness, the top plate 110 and the bottom plate 120 with an equal thickness can fully exert the compressive and tensile properties of the bottom plate 120 and the top plate 110. Wherein, corresponding mounting holes are machined in the first side plate 130 and the second side plate 140 according to the structural features of the arm support 100 for installing an axle sleeve 150, an oil cylinder and etc., and the shape of the bottom plate 120 is matched with a side of the first side plate 130 and a side of the second side plate 140 away from the top plate 110. Since the top plate is a flat plate, the first bending portion and the third bending portion respectively form an included angle with the body of the first side plate 130 and the body of the second side plate 140, and the included angle is 90°, and therefore, both the first bending portion and the third bending portion can be attached to the top plate. In order to be attached to the bottom plate to achieve the firmness of the connection structure, the second bending portion and the fourth bending portion can match the shape of the plate surface of the bottom plate. Therefore, the top plate 110, the bottom plate 120, the first side plate 130 and the second side plate 140 are spliced to each other, and then the arm support 100 is assembled, and compared with the arm support 100 with an integral structure, the cost of the mold for making the arm support 100 is reduced, and at the same time, the production efficiency of the arm support 100 is improved.

Embodiment 2

As shown in FIG. 3, FIG. 6, FIG. 7 and FIG. 8, the present embodiment provides an arm support 100. Besides the technical features of the above embodiment, the present embodiment further comprises the following technical features.

The first bending portion 134 and the second bending portion 136 are respectively integrally formed with the first side plate 130; and the third bending portion 144 and the fourth bending portion 146 are respectively integrally formed with the second side plate 140.

In the embodiment, the two ends of the first side plate 130 are respectively bent to form the first bending portion 134 and the second bending portion 136, thereby improving the molding efficiency of the first side plate. Similarly, the two ends of the second side plate 140 are respectively bent to form the third bending portion 144 and the fourth bending portion 146, thereby improving the molding efficiency of the second side plate 140. Therefore, the production efficiency of the arm support 100 is further improved.

Embodiment 3

As shown in FIG. 4, the present embodiment provides an arm support 100. Besides the technical features of the above embodiments, the present embodiment further comprises the following technical features.

The arm support 100 further comprises a first rib plate 138, provided on the first side plate 130 and disposed between the first bending portion 134 and the second bending portion 136; and a second rib plate 148, provided on the second side plate 140 and disposed between the third bending portion 144 and the fourth bending portion 146.

In the embodiment, the first rib plate 138 and the first side plate 130 are integrally formed, the second rib plate 148 and the second side plate 140 are further integrally formed, and this can not only increase the structure strength of the first side plate 130 and the second side plate 140, but further simplify the structure and simplify the processing technology.

Embodiment 4

As shown in FIG. 3, FIG. 6, FIG. 7 and FIG. 8, the present embodiment provides an arm support 100. Besides the technical features of the above embodiments, the present embodiment further comprises the following technical features.

The arm support 100 further comprises: a middle body 102, a first connecting portion 104 and a second connecting portion 106, wherein the first connecting portion 104 is provided at one end of the middle body 102 in a length direction; the second connecting portion 106 is provided at the other end of the middle body 102 in a length direction; wherein the first connecting portion 104, the second connecting portion 106 and the middle body 102 are enclosed and defined by the top plate 110, the bottom plate 120, the first side plate 130 and the second side plate 140, and the cross sections of the middle body 102 are equal to each other.

The arm support 100 is relatively long, wherein the first connecting portion 104, the second connecting portion 106 and the middle body 102 are enclosed and defined by the top plate 110, the bottom plate 120, the first side plate 130 and the second side plate 140 to form a frame structure. An oil cylinder mounting seat 180 is provided at one end of the first side plate 130 and one end of the second side plate 140 of the middle body 102 away from the top plate 110. The oil cylinder mounting seat 180 comprises two oil cylinder mounting holes provided in the first side plate 130 and the second side plate 140, and the two oil cylinder mounting holes are disposed opposite to each other. The cross sections of the middle body 102 are equal to each other, and the middle body 102 has a simple structure and can be conveniently manufactured, and thus the manufacturing process can be simplified.

Embodiment 5

As shown in FIG. 4, the present embodiment provides an arm support 100. Besides the technical features of the above embodiments, the present embodiment further comprises the following technical features.

The top plate 110 and the bottom plate 120 are respectively carbon fiber plates, and the first side plate 130 and the second side plate 140 are respectively aluminum alloy plates.

In the embodiment, a 7-series aluminum alloy is selected as the top plate 110 and the bottom plate 120, wherein, the 7-series aluminum alloy is a common alloy in aluminum alloys, and includes zinc and magnesium. The aluminum alloy is lighter compared with a steel plate. Therefore, for the arm support 100 assembled by joining carbon fiber plates and aluminum alloy plates, its weight is reduced and its compressive performance is further ensured, and compared with the arm support 100 made from a pure carbon fiber material, the cost of raw materials is reduced. The welding of aluminum alloys has not been the concern of the engineering field all the time, especially the 7 series aluminum alloy. The present disclosure boldly adopts a friction stir welding process of the 7 series aluminum alloy. In addition, by using the combination of the 7-series aluminum alloy and a carbon fiber plate, the cost of the mold for the manufactured arm support 100 is further greatly reduced, and at the same time, compared with the integrally formed carbon fiber arm support, the molding efficiency of the arm support 100 is further improved.

Embodiment 6

Figure 6:
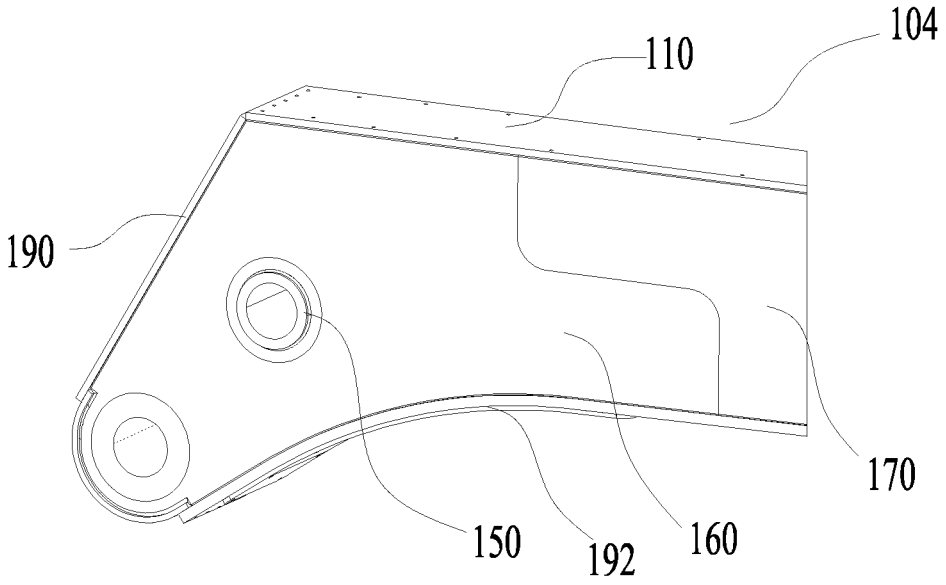
FIG. 6 is a schematic view of a three-dimensional structure of a first connecting portion of an arm support according to the embodiments of the present disclosure.
Figure 7:
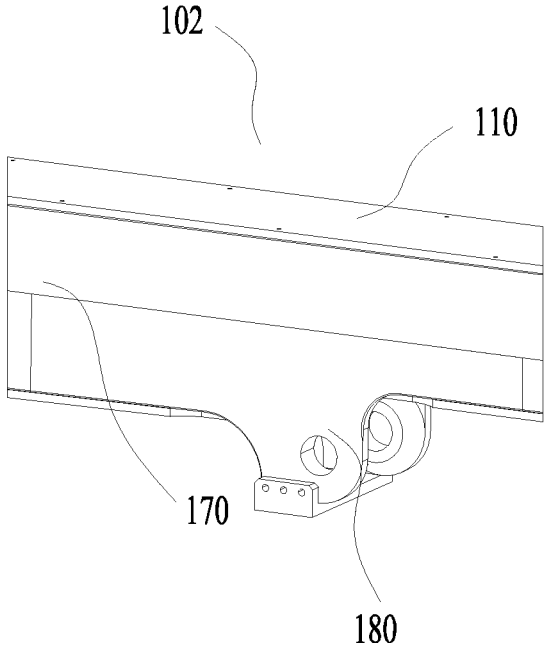
FIG. 7 is a schematic view of a three-dimensional structure of a middle body of an arm support according to the embodiments of the present disclosure.
Figure 8:
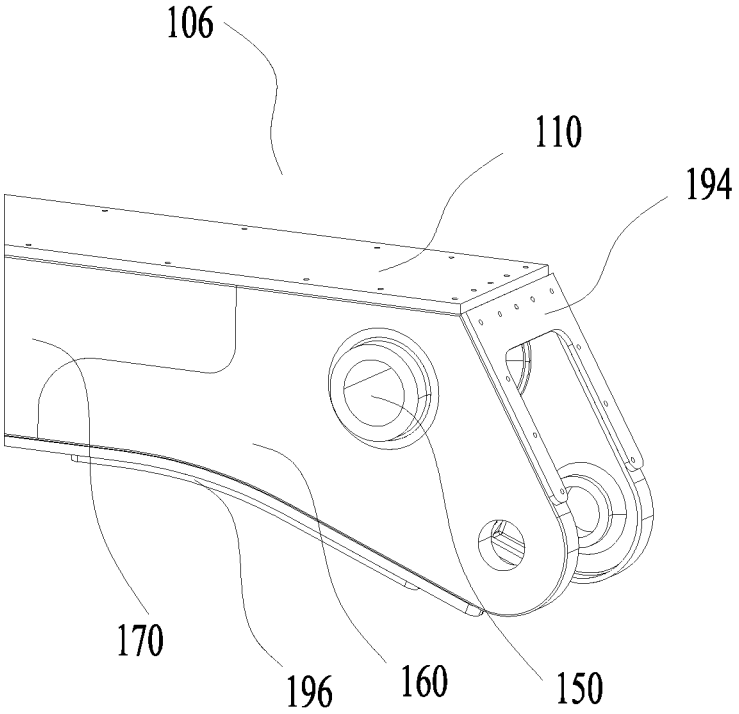
FIG. 8 is a schematic view of a three-dimensional structure of a second connecting portion of an arm support according to the embodiments of the present disclosure.

As shown in FIG. 6 to FIG. 8, the present embodiment provides an arm support 100. Besides the technical features of the above embodiments, the present embodiment further comprises the following technical features.

The arm support 100 further comprises: a first steel guard plate 190, a second steel guard plate 192, a third steel guard plate 194 and a fourth steel guard plate 196, wherein the first steel guard plate is provided on the top of the first connecting portion 104, and the two opposite sides of the first steel guard plate 190 are respectively connected with the first side plate 130 and the second side plate 140; the second steel guard plate 192 is provided at the bottom of the first connecting portion 104, and the second steel guard plate 192 is attached to and fixed with the bottom plate 120; the third steel guard plate 194 is provided on the top of the second connecting portion 106, and the two opposite sides of the third steel guard plate 194 are respectively connected with the first side plate 130 and the second side plate 140; and the fourth steel guard plate 196 is provided at the bottom of the second connecting portion 106, and the fourth steel guard plate 196 is attached to and fixed with the bottom plate 120.

In the embodiment, since the first connecting portion 104 and the second connecting portion 106 need to bear the extruding force and gravity generated by rotating connection in the case of hinged connection, in order to increase the structure strength of the first connecting portion 104, the first steel guard plate 190 is provided on the top of the inclined portion of the first connecting portion 104, the second steel guard plate 192 is provided at the bottom of the inclined portion of the first connecting portion 104, and the second steel guard plate 192 and the bottom plate 120 have the same radian, so that the second steel guard plate 192 and the bottom plate 120 are attached to each other at the portion of the first connecting portion 104. Similarly, in order to increase the structure strength of the second connecting portion 106, the third steel guard plate 194 is provided on the top of the inclined portion of the second connecting portion 106, the fourth steel guard plate 196 is provided at the bottom of the inclined portion of the second connecting portion 106, and the fourth steel guard plate 196 and the bottom plate 120 have the same radian, so that the fourth steel guard plate 196 and the bottom plate 120 are attached to each other at the portion of the second connecting portion 106. The first steel guard plate 190 and the third steel guard plate 194 are welded with the first side plate 130 and the second side plate 140 respectively and connected by fasteners. Other connection structures can further be used. The second steel guard plate 192 and the fourth steel guard plate 196 are respectively connected with the bottom plate 120, for example, friction welding can be used, and then connection is implemented by fasteners such as screws.

Embodiment 7

As shown in FIG. 4, the present embodiment provides an arm support 100. Besides the technical features of the above embodiments, the present embodiment further comprises the following technical features.

The first side plate 130 comprises: a third plate body 132, a first bending portion 134 and a second bending portion 136, wherein the first bending portion 134 is provided at one side of the third plate body 132; the second bending portion 136 is provided at the other side of the third plate body 132 opposite to the first bending portion 134; wherein the first bending portion 134 and the second bending portion 136 are respectively integrally formed with the third plate body 132, at least a portion of the first bending portion 134 is attached to the top plate 110, and at least a portion of the second bending portion 136 is attached to the bottom plate 120.

In the embodiment, the first bending portion 134 and the second bending portion 136 are respectively integrally formed with the third plate body 132; the first bending portion 134 and the second bending portion 136 respectively form an included angle with the third plate body 132, and the included angle is 90°, the top plate 110 is a plate structure, and therefore, the first bending portion 134 can be attached to the top plate 110. The third plate body 132 extends an car plate structure at the connection of the first connecting portion 104 and the end portion of the top plate 110 in a direction away from the second connecting portion 106 and in a direction away from the top plate 110, and therefore, the side of the third plate body 132 located at the first connecting portion 104 away from the top plate 110 is arc-shaped, and the bottom plate 120 located at the first connecting portion 104 is further arc-shaped, and then, the second bending portion 136 located at the first connecting portion 104 is further arc-shaped. Similarly, since the second connecting portion 106 further has an ear plate structure, the side of the third plate body 132 located at the second connecting portion 106 away from the top plate 110 is arc-shaped, and the bottom plate 120 located at the second connecting portion 106 is further arc-shaped, and then, the second bending portion 136 located at the second connecting portion 106 is further arc-shaped. The bottom plate 120 located between the first connecting portion 104 and the second connecting portion 106 can be a plate structure, and thus, the second bending portion 136 located between the first connecting portion 104 and the second connecting portion 106 is further a plate structure, so that the second bending portion 136 is attached to the bottom plate 120; through the first bending portion 134 and the second bending portion 136, the first side plate 130 is spliced to the top plate 110 and the bottom plate 120, and this simplifies the splicing structure and can be achieved easily, and can improve the splicing efficiency of the arm support 100.

The second side plate 140 comprises: a fourth plate body 142, a third bending portion 144 and a fourth bending portion 146, wherein the third bending portion 144 is provided at one end of the fourth plate body 142, and the fourth bending portion 146 is provided at the other end of the fourth plate body 142 opposite to the third bending portion 144; wherein the third bending portion 144 and the fourth bending portion 146 are respectively integrally formed with the fourth plate body 142, at least a portion of the third bending portion 144 is attached to the top plate 110, and at least a portion of the fourth bending portion 146 is attached to the bottom plate 120.

In the embodiment, the third bending portion 144 and the fourth bending portion 146 are respectively integrally formed with the fourth plate body 142; the third bending portion 144 and the fourth bending portion 146 respectively form an included angle with the fourth plate body 142, and the included angle is 90°, the top plate 110 is a plate structure, and therefore, the third bending portion 144 can be attached to the top plate 110. The fourth plate body 142 extends an car plate structure at the connection of the first connecting portion 104 and the end portion of the top plate 110 in a direction away from the second connecting portion 106 and in a direction away from the top plate 110, and therefore, the side of the fourth plate body 142 located at the first connecting portion 104 away from the top plate 110 is arc-shaped, and the bottom plate 120 located at the first connecting portion 104 is arc-shaped, and then, the fourth bending portion 146 located at the first connecting portion 104 is further arc-shaped. Similarly, since the second connecting portion 106 further has an ear plate structure, the side of the fourth plate body 142 located at the second connecting portion 106 away from the top plate 110 is arc-shaped, and the bottom plate 120 located at the second connecting portion 106 is further arc-shaped, and then, the fourth bending portion 146 located at the second connecting portion 106 is further arc-shaped. The bottom plate 120 located between the first connecting portion 104 and the second connecting portion 106 can be a plate structure, and thus, the fourth bending portion 146 located between the first connecting portion 104 and the second connecting portion 106 is further a plate structure, so that the fourth bending portion 146 is attached to the bottom plate 120; through the third bending portion 144 and the fourth bending portion 146, the second side plate 140 is spliced to the top plate 110 and the bottom plate 120, and this simplifies the splicing structure and can be easily achieved, and can improve the splicing efficiency of the arm support 100.

Embodiment 8

Figure 5:
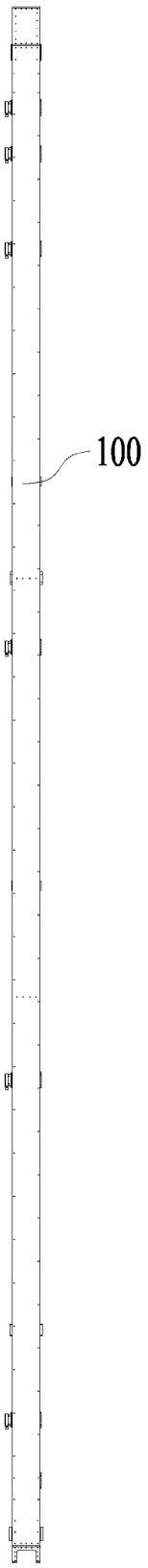
FIG. 5 is a side view of the structure of an arm support according to the embodiments of the present disclosure.

As shown in FIG. 3 to FIG. 5, the present embodiment provides an arm support 100. Besides the technical features of the above embodiments, the present embodiment further comprises the following technical features.

The first side plate 130 and/or the second side plate 140 further comprises: a first plate body 160 and a second plate body 170, wherein the second plate body 170 is connected with the first plate body 160 in the same plane; wherein a thickness of the first plate body 160 is greater than a thickness of the second plate body 170, the first side plate 130 and the second side plate 140 are respectively provided with a first plate body 160 at two ends in the length direction, and the second plate body 170 is respectively connected with the two first plate bodies 160 on two opposite sides by friction stir welding, so as to splice the first side plate 130 or the second side plate 140.

In the embodiment, since the first plate body 160 is located at the end portions of the two ends of the first side plate 130 or the second side plate 140, that is, the first plate body 160 is located at the first connecting portion 104 and the second connecting portion 106, the thickness of the first plate body 160 is greater than that of the second plate body 170, so as to increase structure strength and play a better connecting function. The inner surface of the first plate body 160 and the inner surface of the second plate body 170 are in the same plane, that is, the outer surface of the first plate body 160 protrudes from the outer surface of the second plate body 170, which can facilitate the installation of the axle sleeve 150 and the like on the first connecting portion 104 and the second connecting portion 106, and makes the connection between multiple arm supports 100 more convenient. Friction welding is a method of using the heat generated by the mutual movement and the mutual friction of the end faces of a workpiece to achieve a thermoplastic state of end portions, and then quickly conducting upsetting and completing welding. Friction stir welding is a kind of friction welding. The friction stir welding further uses friction heat and plastic deformation heat as welding heat sources. Being different from an ordinary friction welding, the welding process of the friction stir welding is that a stirring needle of a cylinder shape or another shape (for example, a threaded cylinder) is extended into the joint of a workpiece, and the high-speed rotation of a welding head makes it rub against a welding workpiece material, and then the temperature of the material at the connection portion raises and then the material is softened. The first plate body 160 and the second plate body 170 are connected to each other through the friction stir welding, which can ensure the integral structure strength of the first side plate 130 or the second side plate 140.

Embodiment 9

As shown in FIG. 3 to FIG. 8, the present embodiment provides an arm support 100. Besides the technical features of the above embodiments, the present embodiment further comprises the following technical features.

The arm support 100 further comprises: an axle sleeve 150, wherein the axle sleeve 150 is connected with the first side plate 130 and/or the second side plate 140 through friction welding; wherein the first side plate 130 and the second side plate 140 are provided with at least two axle sleeves opposite to each other.

In the embodiment, the axle sleeve 150 in the first side plate 130 and the axle sleeve 150 in the second side plate 140 are symmetrically arranged, and the axle sleeve 150 and the first side plate 130 or the second side plate 140 are further connected by friction welding, wherein the friction welding can further be friction stir welding. The friction stir welding is a mature welding process and is not repeated herein.

Embodiment 10

As shown in FIG. 4, the present embodiment provides an arm support 100. Besides the technical features of the above embodiments, the present embodiment further comprises the following technical features.

The top plate 110 and the bottom plate 120 are respectively bonded with and mechanically connected with the first side plate 130 and the second side plate 140.

In the embodiment, the first side plate 130 is bonded with and mechanically connected with the top plate 110 and the bottom plate 120, and the second side plate 140 is bonded with and mechanically connected with the top plate 110 and the bottom plate 120, wherein the mechanical connection is a fastener connecting or riveting, and the fastener connecting can be screw connection, bolt connection, and etc. For example, the top plate 110 and the bottom plate 120 are respectively bonded with the first bending portion 134 and the second bending portion 136, and then they are connected through fasteners. Similarly, the top plate 110 and the bottom plate 120 are respectively bonded with the third bending portion 144 and the fourth bending portion 146, and then they are connected through fasteners.

Embodiment 11

The present embodiment provides a working device, which can be a device with a working arm support, such as a concrete pump truck, a fire truck and a crane. The working device comprises a chassis and an arm support system, wherein the arm support system is provided on the chassis, and the arm support system is provided with a pump tube for conveying materials; wherein the arm support system comprises the arm support 100 in any one of the above embodiments, and two adjacent arm supports 100 are hinged to each other.

In the embodiment, the arm support system is composed of parts such as multiple sections of arm supports 100, a connecting rod, an oil cylinder and a connecting member. When the working device is working, the arm support system is driven by a hydraulic oil cylinder and then is unfolded and extended to convey materials. During the driving process of the working device, the arm support system needs to be folded and placed in the vehicle body, and therefore, under the effect of the telescopic rod of the oil cylinder, the working device has a foldable or telescopic arm support system.

To sum up, the embodiments of the present disclosure have the following beneficial effects.

The arm support 100 is joined through the top plate 110, the bottom plate 120, the first side plate 130 and the second side plate 140, which is suitable for mass production, and compared with an integrally formed mold, a variety of simple molds are used, and the cost of later design changes is low.

Carbon fiber plates are used as the top plate 110 and the bottom plate 120, and aluminum alloy plates and sectional materials are used as the first side plate 130 and the second side plate 140, so that the costs of raw materials and molds are lower compared with the pure carbon fiber arm support, and compared with the steel arm support, the weight is reduced by more than 35%, the stress is lowered by more than 50%, and the rigidity is lowered by less than 10%.

The difficulty and cost of later maintenance of the spliced arm support 100 are far less than the arm support that is integrally formed with carbon fiber composite materials.

In the present disclosure, the terms of "first", "second" and "third" are used only for the purpose of description and shall not be understood to indicate or imply any relative importance; the term of "multiple" refers to two or more, unless otherwise clearly defined. The terms of "mounting", "connected to". "connected with", "fix" and the like should be understood in a broad sense, for example, the term "connect with" can be a fixed connection, a detachable connection, or an integral connection; the term "connected to" can be a direct connection or an indirect connection through an intermediate medium. For a person skilled in the art, they may understand the specific meanings of the above-mentioned terms in the present disclosure according to specific circumstances.

In the description of the present disclosure, it needs to be understood that the orientation or position relations indicated by the terms of "upper", "lower", "left", "right", "front", "rear" and the like are based on the orientation or position relations shown in the accompanying drawings, and they are just intended to conveniently describe the present disclosure and simplify the description, and are not intended to indicate or imply that the devices or units as indicated should have specific orientations or should be configured or operated in specific orientations, and then should not be construed as limitations to the present disclosure.

In the specification of the present disclosure, the description of the terms of "an embodiment", "some embodiments", "specific embodiment" and the like is intended to mean that the specific features, structures, materials or characteristics described in combination with the embodiments or examples are included in at least one embodiment or example of the present disclosure. In the specification, the illustrative expression of the above terms may not indicate the same embodiment or example. In addition, the specific features, structures, materials or characteristics described above may be combined with each other in an appropriate method in one or more of any embodiments or examples.

The above-mentioned are merely some exemplary embodiments of the present disclosure and not intended to limit the present disclosure, and for one skilled in the art, various modifications and changes may be made to the present disclosure. Any modifications, equivalent substitutions, improvements and so on made within the spirit and principle of the present disclosure should be covered within the scope of protection of the present disclosure.

What is claimed is:

1. An arm support comprising a frame structure, wherein the arm support comprises:

a top plate;

a bottom plate, wherein the bottom plate and the top plate are oppositely disposed at an interval;

a first side plate;

a second side plate, wherein the second side plate and the first side plate are oppositely disposed at an interval, wherein a first side of the first side plate is provided with a first bending portion, at least a portion of the first bending portion and the top plate are attached and spliced to each other, a second side of the first side plate opposite to the first bending portion is provided with a second bending portion, at least a portion of the second bending portion and the bottom plate are attached and spliced to each other; and a first side of the second side plate is provided with a third bending portion, at least a portion of the third bending portion and the top plate are attached and spliced to each other, a second side of the second side plate opposite to the third bending portion is provided with a fourth bending portion, at least a portion of the fourth bending portion and the bottom plate are attached and spliced to each other, and define the frame structure;

the top plate and the bottom plate are respectively carbon fiber plates, and the first side plate and the second side plate are respectively aluminum alloy plates.

2. The arm support according to claim 1, wherein the first bending portion and the second bending portion are respectively integrally formed with the first side plate; and the third bending portion and the fourth bending portion are respectively integrally formed with the second side plate.

3. The arm support according to claim 1, further comprising:

a first rib plate, provided on the first side plate and disposed between the first bending portion and the second bending portion; and a second rib plate, provided on the second side plate and disposed between the third bending portion and the fourth bending portion.

4. The arm support according to claim 1, further comprising:

a middle body;

a first connecting portion, provided at one end of the middle body in a length direction;

a second connecting portion, provided at another end of the middle body in the length direction; and wherein the first connecting portion, the second connecting portion and the middle body are enclosed and defined by the top plate, the bottom plate, the first side plate and the second side plate.

5. The arm support according to claim 4, further comprising:

a first steel guard plate, provided on a top of the first connecting portion, wherein two opposite sides of the first steel guard plate are respectively connected with the first side plate and the second side plate;

a second steel guard plate, provided at a bottom of the first connecting portion, wherein the second steel guard plate is attached to and fixed with the bottom plate;

a third steel guard plate, provided on a top of the second connecting portion, wherein the two opposite sides of the third steel guard plate are respectively connected with the first side plate and the second side plate; and a fourth steel guard plate, provided at a bottom of the second connecting portion, wherein the fourth steel guard plate is attached to and fixed with the bottom plate.

6. The arm support according to claim 1, wherein, the first side plate and the second side plate further comprise:

a first plate body;

a second plate body, disposed with the first plate body side by side; and wherein a thickness of the first plate body is greater than a thickness of the second plate body, the first side plate or the second side plate is respectively provided with two first plate bodies at two respective ends in a length direction, and the two first plate bodies are connected on opposite ends of the respective second plate body along a length direction by friction welding, to splice out the first side plate or the second side plate.

7. The arm support according to claim 1, further comprising:

an axle sleeve, connected with the first side plate or the second side plate through friction welding;

wherein the first side plate and the second side plate are provided with at least two axle sleeves opposite to each other.

8. The arm support according to claim 1, wherein the top plate and the bottom plate are respectively bonded with and mechanically connected with the first side plate and the second side plate.

9. A working device, comprising:

a chassis; and an arm support system, provided on the chassis, wherein the arm support system is provided with a pump tube for conveying materials;

wherein the arm support system comprises a plurality of arm supports, and two adjacent arm supports are hinged to each other;

wherein each of the plurality of arm supports comprises a frame structure, wherein each of the plurality of arm supports comprises:

a top plate;

a bottom plate, wherein the bottom plate and the top plate are oppositely disposed at an interval;

a first side plate;

a second side plate, wherein the second side plate and the first side plate are oppositely disposed at an interval, wherein a first side of the first side plate is provided with a first bending portion, at least a portion of the first bending portion and the top plate are attached and spliced to each other, a second side of the first side plate opposite to the first bending portion is provided with a second bending portion, at least a portion of the second bending portion and the bottom plate are attached and spliced to each other; and a first side of the second side plate is provided with a third bending portion, at least a portion of the third bending portion and the top plate are attached and spliced to each other, a second side of the second side plate opposite to the third bending portion is provided with a fourth bending portion, at least a portion of the fourth bending portion and the bottom plate are attached and spliced to each other, and define the frame structure;

the top plate and the bottom plate are respectively carbon fiber plates, and the first side plate and the second side plate are respectively aluminum alloy plates.

10. The working device according to claim 9, wherein the first bending portion and the second bending portion are respectively integrally formed with the first side plate; and the third bending portion and the fourth bending portion are respectively integrally formed with the second side plate.

11. The working device according to claim 9, further comprising:

a first rib plate, provided on the first side plate and disposed between the first bending portion and the second bending portion; and a second rib plate, provided on the second side plate and disposed between the third bending portion and the fourth bending portion.

12. The working device according to claim 9, further comprising:

a middle body;

a first connecting portion, provided at one end of the middle body in a length direction;

a second connecting portion, provided at another end of the middle body in the length direction; and wherein the first connecting portion, the second connecting portion and the middle body are enclosed and defined by the top plate, the bottom plate, the first side plate and the second side plate.

13. The working device according to claim 12, further comprising:

a first steel guard plate, provided on a top of the first connecting portion, wherein two opposite sides of the first steel guard plate are respectively connected with the first side plate and the second side plate;

a second steel guard plate, provided at a bottom of the first connecting portion, wherein the second steel guard plate is attached to and fixed with the bottom plate;

a third steel guard plate, provided on a top of the second connecting portion, wherein two opposite sides of the third steel guard plate are respectively connected with the first side plate and the second side plate; and a fourth steel guard plate, provided at a bottom of the second connecting portion, wherein the fourth steel guard plate is attached to and fixed with the bottom plate.

* * * * *